US009680210B2

(12) United States Patent
Ella

(10) Patent No.: US 9,680,210 B2
(45) Date of Patent: Jun. 13, 2017

(54) ANTENNA ARRANGEMENT

(75) Inventor: Juha Sakari Ella, Halikko (FI)

(73) Assignee: Nokia Technologies Oy, Espoo (FI)

( * ) Notice: Subject to any disclaimer, the term of this patent is extended or adjusted under 35 U.S.C. 154(b) by 1800 days.

(21) Appl. No.: 12/448,293

(22) PCT Filed: Dec. 19, 2006

(86) PCT No.: PCT/IB2006/004166

§ 371 (c)(1),
(2), (4) Date: Dec. 7, 2009

(87) PCT Pub. No.: WO2008/075133

PCT Pub. Date: Jun. 26, 2008

(65) Prior Publication Data

US 2010/0090909 A1 Apr. 15, 2010

(51) Int. Cl.

| | |
|---|---|
| ***H01Q 1/24*** | (2006.01) |
| ***H01Q 1/38*** | (2006.01) |
| ***H01Q 9/40*** | (2006.01) |
| ***H01Q 9/42*** | (2006.01) |
| ***H01Q 21/30*** | (2006.01) |

(52) U.S. Cl.

CPC ..... *H01Q 1/38* (2013.01); *H01Q 1/243* (2013.01); *H01Q 9/40* (2013.01); *H01Q 9/42* (2013.01); *H01Q 21/30* (2013.01)

(58) Field of Classification Search

CPC H01Q 21/30; H01Q 9/42; H01Q 9/40; H01Q 1/243

USPC ..... 343/700 MS, 702, 846

See application file for complete search history.

(56) References Cited

U.S. PATENT DOCUMENTS

| | | | | |
|---|---|---|---|---|
| 5,861,854 | A | 1/1999 | Kawahata et al. | 343/702 |
| 6,476,769 | B1 | 11/2002 | Lehtola | 343/702 |
| 6,535,170 | B2 * | 3/2003 | Sawamura et al. | 343/702 |
| 6,600,450 | B1 * | 7/2003 | Efanov et al. | 343/726 |
| 6,650,294 | B2 * | 11/2003 | Ying et al. | 343/700 MS |
| 6,943,746 | B2 * | 9/2005 | Talvitie et al. | 343/767 |
| 6,980,155 | B2 * | 12/2005 | Lee et al. | 343/700 MS |
| 7,026,996 | B2 | 4/2006 | Harano | 343/700 |
| 7,123,209 | B1 | 10/2006 | Desclos et al. | 343/860 |
| 7,148,846 | B2 | 12/2006 | Qi et al. | 343/700 MS |
| 7,242,364 | B2 | 7/2007 | Ranta | 343/860 |

(Continued)

FOREIGN PATENT DOCUMENTS

EP 1 128 466 8/2001

OTHER PUBLICATIONS

Villanen, J., et al., "Compact Antenna Structures for Mobile Handsets", © 2003 IEEE, pp. 40-44.

*Primary Examiner* — Dameon E Levi
*Assistant Examiner* — Hasan Islam
(74) *Attorney, Agent, or Firm* — Harrington & Smith

(57) ABSTRACT

An antenna arrangement including a first antenna element connected to a first feed point and having a first electrical length; a second antenna element connected to a second feed point, different to the first feed point, and including: a first portion which extends from the second feed point and has a second electrical length, similar to the first electrical length, which enables the first portion to electromagnetically couple with the first antenna element, and a second portion which extends from the second feed point and has a third electrical length, different to the first electrical length of the first antenna element and to the second electrical length of the first portion.

18 Claims, 8 Drawing Sheets

(56) References Cited

U.S. PATENT DOCUMENTS

| | | | | |
|---|---|---|---|---|
| 7,289,068 | B2 * | 10/2007 | Fujio et al. | 343/700 MS |
| 7,298,339 | B1 * | 11/2007 | Ollikainen | H01Q 1/243 343/700 MS |
| 7,411,556 | B2 * | 8/2008 | Sanz et al. | 343/702 |
| 7,535,422 | B2 * | 5/2009 | Liu et al. | 343/702 |
| 7,616,158 | B2 * | 11/2009 | Mak et al. | 343/700 MS |
| 7,782,261 | B2 * | 8/2010 | An et al. | 343/702 |
| 7,898,485 | B2 * | 3/2011 | Schlub et al. | 343/702 |
| 7,973,726 | B2 * | 7/2011 | Tseng et al. | 343/702 |
| 2004/0075613 | A1 * | 4/2004 | Jarmuszewski et al. | 343/702 |
| 2004/0113847 | A1 | 6/2004 | Qi et al. | 343/702 |
| 2006/0227054 | A1 * | 10/2006 | Wang | H01Q 9/0421 343/702 |
| 2007/0268190 | A1 * | 11/2007 | Huynh | 343/702 |

* cited by examiner

ANTENNA ARRANGEMENT

FIELD OF THE INVENTION

Embodiments of the present invention relate to an antenna arrangement. In particular, they relate to an antenna arrangement for a mobile cellular phone.

BACKGROUND TO THE INVENTION

In recent years, it has become desirable for radio communication devices to become smaller so that they may be carried more easily by a user. However, the bandwidth of an antenna arrangement in such a device is usually affected by the size of the device. Generally, the bandwidth of the antenna arrangement decreases as the size of the device is reduced. For example, the bandwidth of the antenna arrangement decreases if the dimensions of the ground plane (usually the printed wiring board of the device) are reduced, or if the height of the antenna arrangement above the ground plane is reduced.

Currently, antenna arrangements are provided whereby each antenna is connected to a tuneable load which can shift the narrow bandwidth of each antenna to the correct operational frequency. For example, the tuneable loads may shift the operational frequency from GSM 1800 to GSM 1900. However, tuneable loads increase the number of components in the device and may increase the cost of the device.

Therefore, it would be desirable to provide an alternative antenna arrangement.

BRIEF DESCRIPTION OF THE INVENTION

According to one embodiment of the present invention there is provided an antenna arrangement comprising: a first antenna element connected to a first feed point and having a first electrical length; a second antenna element connected to a second feed point, different to the first feed point, and including: a first portion which extends from the second feed point and has a second electrical length, similar to the first electrical length, which enables the first portion to electromagnetically couple with the first antenna element, and a second portion which extends from the second feed point and has a third electrical length, different to the first electrical length of the first antenna element and to the second electrical length of the first portion.

At least a part of the first portion of the second antenna element may extend from the second feed point towards the first antenna element. At least a part of the first portion of the second antenna element may be oriented so that it is substantially parallel to the first antenna element.

The first antenna element may be physically connected to only the first feed point. The first antenna element may be a planar inverted L antenna. The first antenna element may have a resonant mode at $\lambda/4$.

The second antenna element may be physically connected to only the second feed point. The second antenna element may be a planar inverted L antenna. The second antenna may have a resonant mode at $\lambda/4$.

The first antenna element may be connectable to a first transceiver via the first feed point. The second antenna element may be connectable to a second transceiver via the second feed point. The first transceiver may be different to the second transceiver.

The first antenna element and the second antenna element may be connectable to a single transceiver via the first feed point and the second feed point respectively.

The first antenna element may be operable to resonate within a first resonant frequency band. The first portion of the second antenna element may be operable to resonate within a second resonant frequency band. The first resonant frequency band and the second resonant frequency band may have at least partially overlapping frequencies.

The second portion of the second antenna element may be operable to resonate within a third resonant frequency band. The third resonant frequency band may be different to the first resonant frequency band and to the second resonant frequency band.

According to another embodiment of the present invention, there is provided a device comprising an antenna arrangement as described in the preceding paragraphs.

According to a further embodiment of the present invention, there is provided a portable electronic device comprising an antenna arrangement as described in the preceding paragraphs.

According to another embodiment of the present invention, there is provided a mobile cellular telephone comprising an antenna arrangement as described in the preceding paragraphs.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
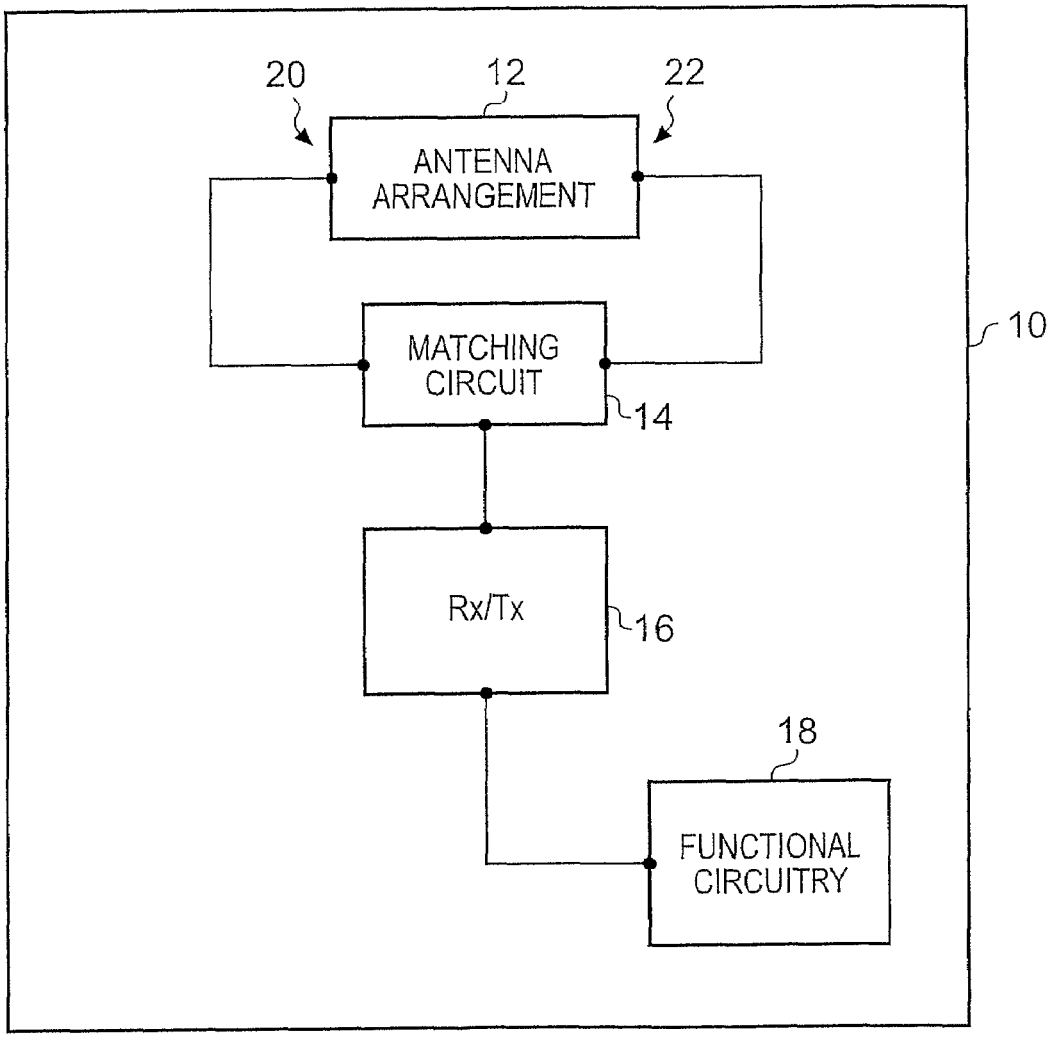
FIG. 1 illustrates a schematic diagram of a device including an antenna arrangement according to a first embodiment of the present invention.

FIGS. 3, 4, 5A, 5B, 5C, 7, 8 and 9 illustrate an antenna arrangement 12 comprising: a first antenna element 34 connected to a first feed point 20 and having a first electrical length; a second antenna element 36 connected to a second feed point 22, different to the first feed point 20, and including: a first portion 40 which extends from the second feed point 22 and has a second electrical length, similar to the first electrical length, which enables the first portion 40 to electromagnetically couple with the first antenna element 34, and a second portion 42 which extends from the second feed point 22 and has a third electrical length, different to the first electrical length of the first antenna element 34 and to the second electrical length of the first portion 40.

FIG. 1 illustrates a device 10 such as a portable electronic device (for example, a mobile cellular telephone), a cellular base station, other radio communication device or module for such devices according to a first embodiment of the present invention.

The device 10 comprises an antenna arrangement 12, a matching circuit 14, a transceiver 16 and functional circuitry 18. The antenna arrangement 12 includes a first feed point 20 and a second feed point 22. The matching circuit 14 is connected to the first feed point 20, the second feed point 22 and to the transceiver 16. In one embodiment, the matching circuit 14 is a diplexer and matches the antenna arrangement to a single 50 ohm point. The functional circuitry 18 is connected to the transceiver 16 and is operable to provide signals to, and receive signals from the transceiver 16.

In the embodiment where the device 10 is a mobile cellular telephone, the functional circuitry 18 includes a processor, a memory and input/output devices such as a microphone, a loudspeaker and a display. The electronic components that provide the matching circuit 14, the transceiver 16 and the functional circuitry 18 are interconnected via a printed wiring board (PWB). The PWB may be used as a ground plane for the antenna arrangement 12.

Figure 2:
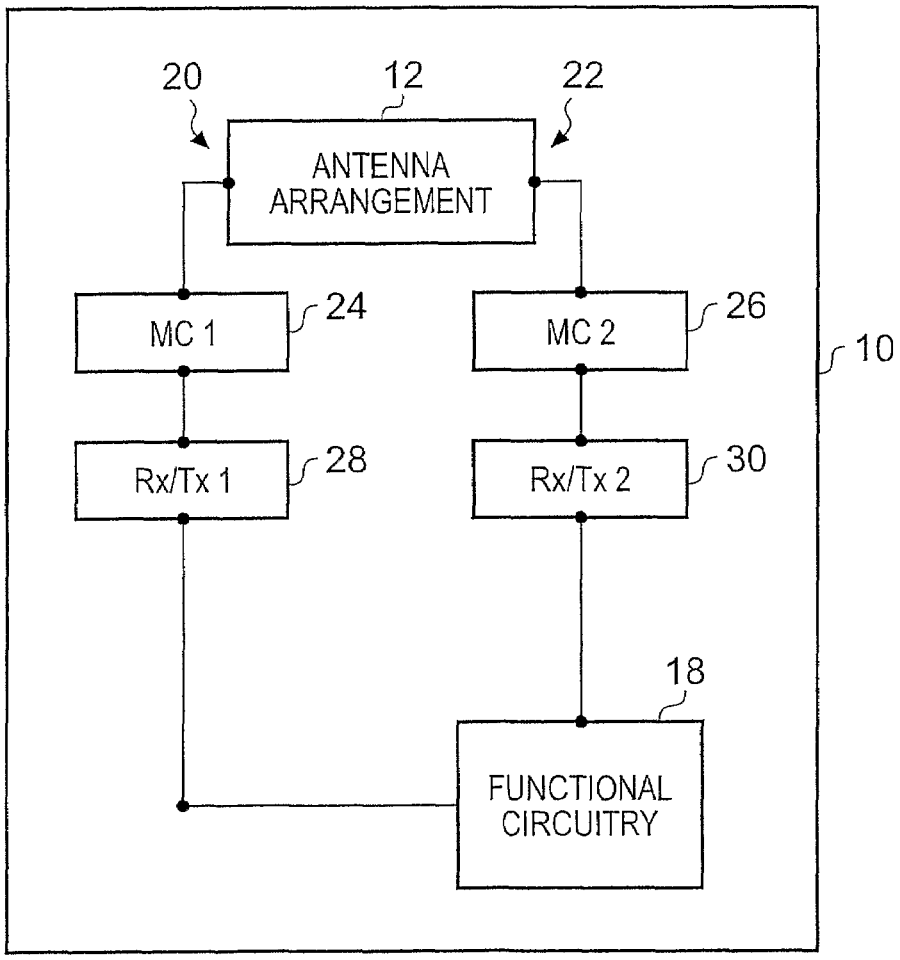
FIG. 2 illustrates a schematic diagram of a device including an antenna arrangement according to a second embodiment of the present invention.

FIG. 2 illustrates a device 10 such as a portable electronic device (for example, a mobile cellular telephone), a cellular base station, other radio communication device or module for such devices according to a second embodiment of the present invention.

The device 10 comprises an antenna arrangement 12, a first matching circuit 24, a second matching circuit 26, a first transceiver 28, a second transceiver 30 and functional circuitry 18. The antenna arrangement 12 includes a first feed point 20 and a second feed point 22. The first matching circuit 24 is connected to the first feed point 20 of the antenna arrangement 12 and to the first transceiver 28. The second matching circuit 26 is connected to the second feed point 22 of the antenna arrangement 12 and to the second transceiver 30. In one embodiment, the first and second matching circuits 24, 26 match the first and second feed points 20, 22 to 50 ohm points. The functional circuitry 18 is connected to the first transceiver 28 and to the second transceiver 30 and is operable to provide signals to, and receive signals from them.

In the embodiment where the device 10 is a mobile cellular telephone, the functional circuitry 18 includes a processor, a memory and input/output devices such as a microphone, a loudspeaker and a display. The electronic components that provide the first matching circuit 24, the second matching circuit 26, the first transceiver 28, the second transceiver 30 and the functional circuitry 18 are interconnected via a printed wiring board (PWB). The PWB may be used as a ground plane for the antenna arrangement 12.

The embodiment illustrated in FIG. 2 may provide an advantage over the embodiment illustrated in FIG. 1 in that the transceivers 28, 30 may require fewer switch contacts than the transceiver 16. This may result in the transceivers 28, 30 having a lower insertion loss than the transceiver 16. Additionally, the transceivers 28, 30 may be less complex than the transceiver 16 and they may therefore be less costly. Additionally, the matching circuits 24, 26 may be less complex than the matching circuit 14 as they are optimised for smaller frequency ranges. Consequently, the matching circuits 24, 26 may be less costly and easier to design than the matching circuit 14.

Figure 3:
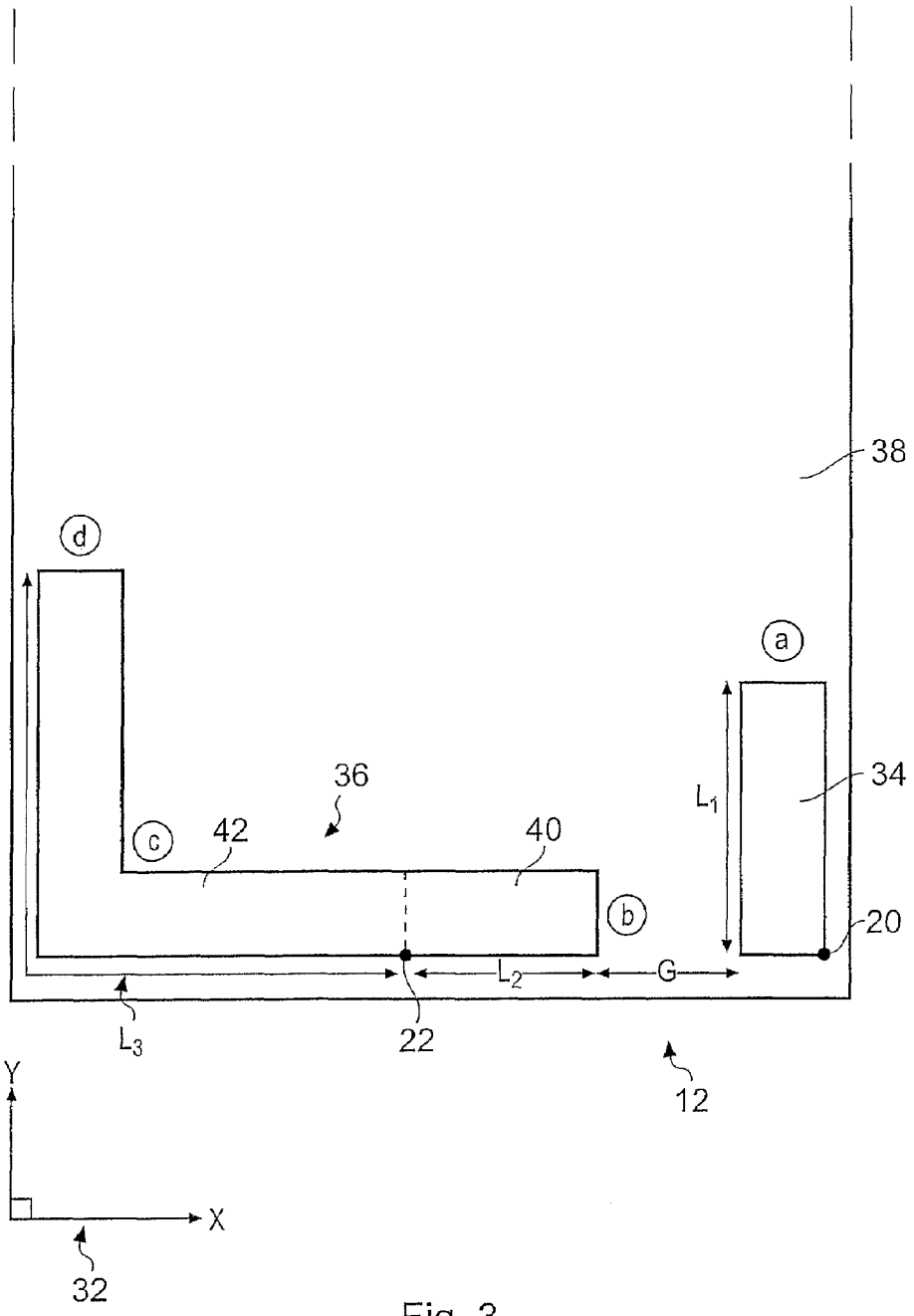
FIG. 3 illustrates a plan view of an antenna arrangement according to one embodiment of the present invention.

FIG. 3 illustrates a plan view of one embodiment of an antenna arrangement 12 according to one embodiment of the present invention. A co-ordinate system 32 is included in FIGS. 3 and 4. The co-ordinate system 32 is a Cartesian co-ordinate system and comprises an x vector that is orthogonal to a y vector, and a z vector (see FIG. 4) that is orthogonal to both the x vector and the y vector.

Figure 4:
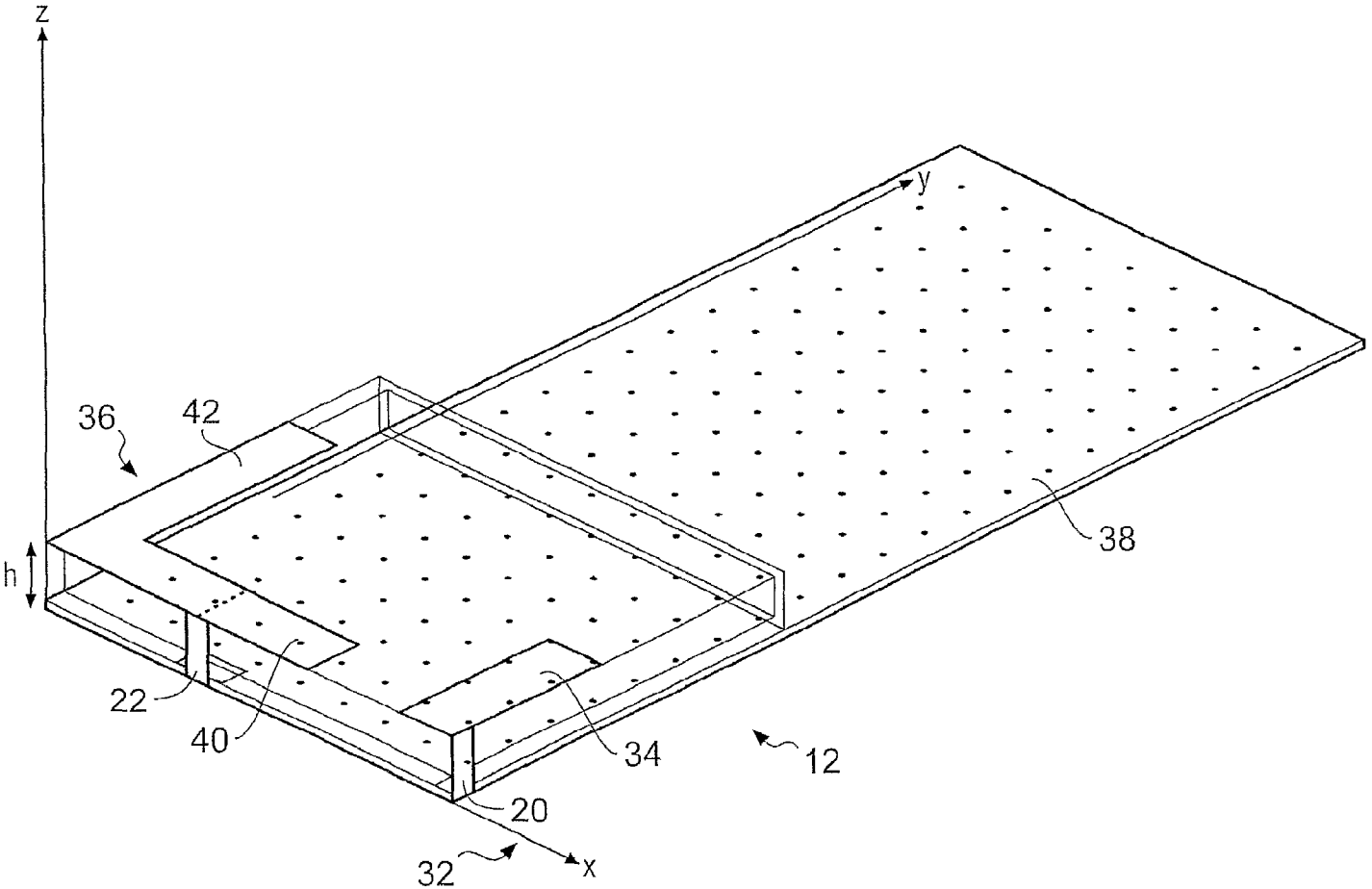
FIG. 4 illustrates a perspective view of the antenna arrangement illustrated in FIG. 3.

The antenna arrangement 12 includes a first antenna element 34 which is connected to the first feed point 20 and a second antenna element 36 which is connected to the second feed point 22. The first antenna element 34 and the second antenna element 36 are mounted over a printed wiring board (PWB) 38 which acts as a ground plane for the antenna arrangement. As illustrated in FIG. 4, the first antenna element 34 and the second antenna element 36 are mounted above the ground plane 38 in the +z direction at a height h.

In this embodiment, the first antenna element 34 and the second antenna element 36 are planar inverted L antennas and are physically connected (e.g. via a galvanic connection) to only the first feed point 20 and to only the second feed point 22 respectively. The structure and functions of the first and second antenna elements 34, 36 are explained in greater detail in the following paragraphs.

The first antenna element 34 extends from the feed point 20 in a +y direction to its end point (a). The second antenna element 36 includes a first portion 40 and a second portion 42. The first portion 40 extends from the second feed point 22 towards the first antenna element 34, in a +x direction, to its end point (b). The second portion 42 extends from the second feed point 22 in a −x direction until point (c) where it makes a right handed, right angled turn. From point (c), the second portion 42 extends in a +y direction to its end point (d).

The first antenna element 34 has a length $L_1$ and has at least one operable resonant mode at $L_1=\lambda/4$ (assuming that physical length and electrical length are the same). The first portion 40 of the second antenna element 36 has a length $L_2$ and has at least one operable resonant mode at $L_2=\lambda/4$. The second portion 42 of the second antenna element 36 has a length $L_3$ and has at least one operable resonant mode at $L_3=\lambda/4$.

It should be appreciated that the electrical length of an antenna is usually equal to the length of the resonating portion of the antenna plus any shortening/lengthening effect provided by reactive components in a connected matching circuit. For example, the electrical length of an antenna will be increased if it is connected to a plurality of inductors arranged in series. Similarly, the electrical length of an antenna will be decreased if it is connected to a capacitor in series. Therefore, the electrical lengths of the first antenna element 34, first portion 40 and second portion 42 of the second antenna element 36 may be selected by altering the reactive components in the matching circuits 14, 24, 26.

The length of the first antenna element 34, $L_1$, is selected so that it is operable to transmit and receive signals within a first resonant frequency band. Similarly, the lengths of the first portion 40 and the second portion 42, $L_2$ & $L_3$ respectively, are selected so that they are operable to transmit and receive signals within second and third resonant frequency bands respectively. It should be appreciated that the electrical lengths of the first antenna element $L_1$ and the first portion $L_2$ are similar (and in some embodiments may be substantially the same) since they are selected so that they resonate within similar resonant frequency bands. This means that the frequencies of the first resonant frequency band at least partially overlap with the frequencies of the second resonant frequency band (i.e. the two frequency bands share a common set of frequencies). The third resonant frequency band is different to the first and second resonant frequency bands and does not share any frequencies with them.

In operation, the antenna arrangement 12 can be electrically fed via the first feed point 20 and/or via the second feed point 22.

Figure 5A:
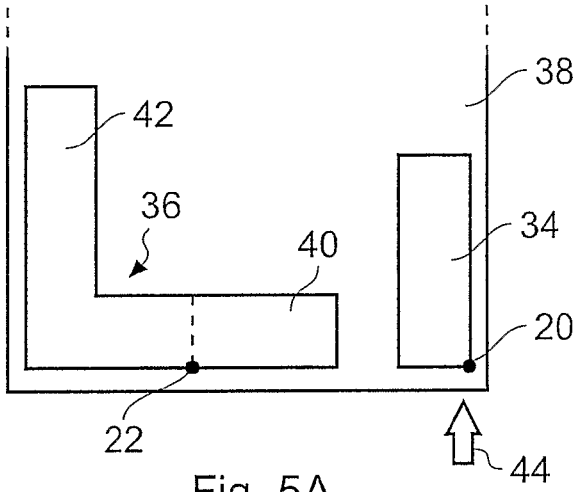
FIG. 5A illustrates a plan view of the antenna arrangement illustrated in FIGS. 3 and 4 with only the first antenna element being fed.

As illustrated in FIG. 5A, if the antenna arrangement 12 is fed only via the first feed point 20 (indicated by arrow 44) and not via the second feed point 22, then only the first antenna element 34 is directly electrically fed. As a result, the first antenna element 34 produces a signal within the first resonant frequency band. However, since $L_2$ is similar to $L_1$ as mentioned above and since the first portion 40 is oriented towards the first antenna element 34, the first antenna element 34 electromagnetically couples with the (unfed) first portion 40. As a result of this electromagnetic coupling, the first portion 40 is electromagnetically fed by the first antenna element 34 and produces a signal within the second resonant frequency band, i.e. the first portion 40 acts as a parasitic resonator for the first antenna element 34.

Figure 5B:
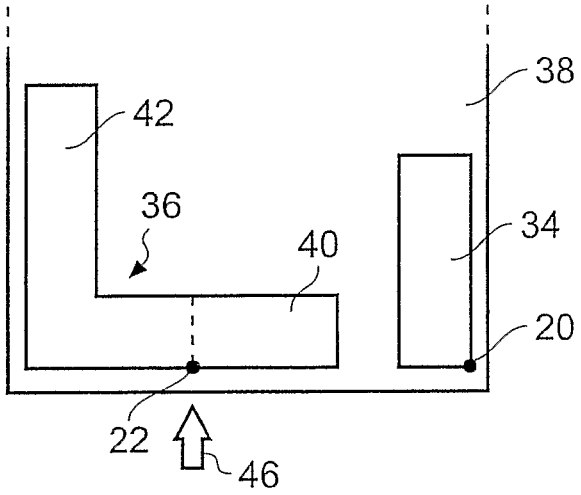
FIG. 5B illustrates a plan view of the antenna arrangement illustrated in FIGS. 3 and 4 with only the second antenna element being fed.

As illustrated in FIG. 5B, if the antenna arrangement 12 is fed only via the second feed point 22 (indicated by arrow 46) and not via the first feed point 20, then only the second antenna element 36 is directly electrically fed. As a result, the first portion 40 produces a signal within the second resonant frequency band and the second portion 42 produces a signal within the third resonant frequency band. The first portion 40 electromagnetically couples with the (unfed) first antenna element 34. As a result of this electromagnetic coupling, the first antenna element 34 is electromagnetically fed by the first portion 40 and produces a signal within the first resonant frequency band, i.e. the first antenna element 34 acts as a parasitic resonator for the first portion 40.

Figure 5C:
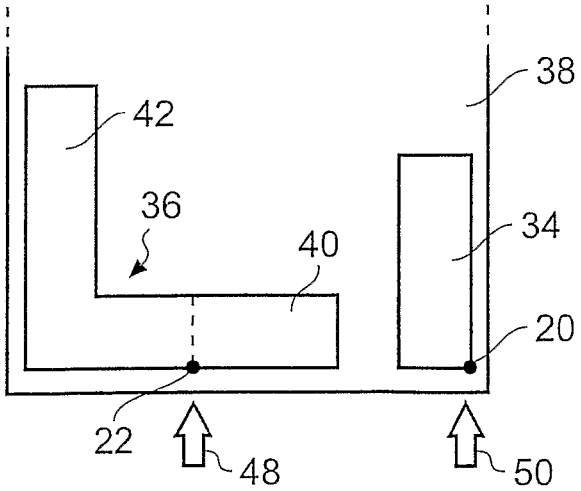
FIG. 5C illustrates a plan view of the antenna arrangement illustrated in FIGS. 3 and 4 with the first and second antenna elements being fed.

As illustrated in FIG. 5C, if the antenna arrangement 12 is fed via the first feed point 20 and via the second feed point 22 (indicated by arrows 48 and 50 respectively), then the first antenna element 24, the first portion 40 and the second portion 42 produce signals within their respective resonant frequency bands.

The functional circuitry 18 illustrated in FIG. 1 is operable to control the transceiver 16 to switch between the configurations illustrated in FIGS. 5A, 5B and 5C. Specifically, the functional circuitry 18 can control the transceiver 16 to provide an output to the first feed point 20 and/or the second feed point 22. In this way, the functional circuitry 18 can select the first antenna element 34 and/or the second antenna element 36 for operation.

The functional circuitry 18 illustrated in FIG. 2 is operable to control the first transceiver 28 and the second transceiver 30 to switch between the configurations illustrated in FIGS. 5A, 5B and 5C. Specifically, the functional circuitry 18 can control the first transceiver 28 and the second transceiver 30 so that an output is provided to the first feed point 20 and/or the second feed point 22. As mentioned in the previous paragraph, in this way the functional circuitry 18 can select the first antenna element 34 and/or the second antenna element 36 for operation.

Figure 6:
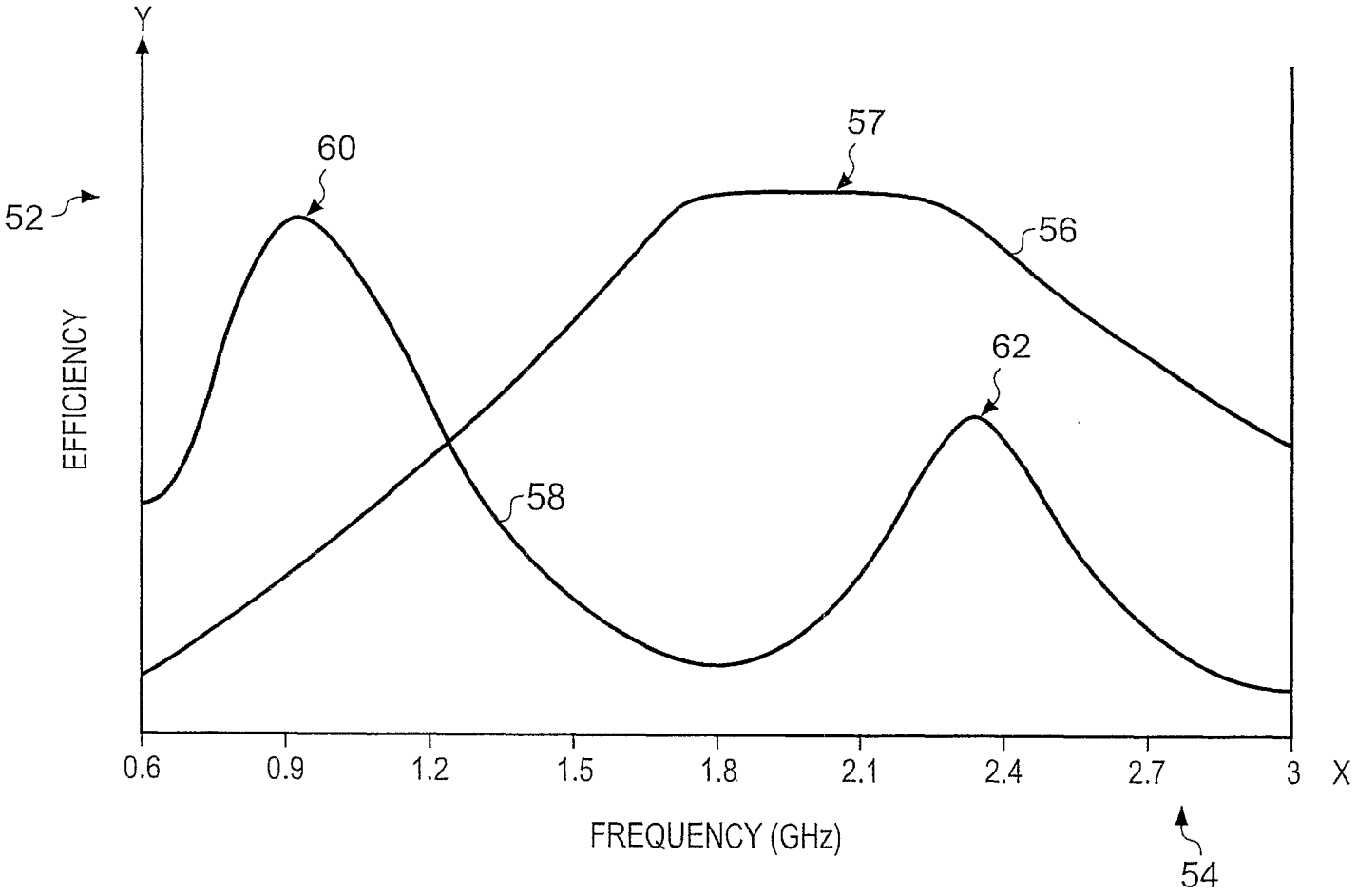
FIG. 6 illustrates a graph of efficiency versus frequency for an antenna arrangement according to one embodiment of present invention.

In one embodiment, the antenna arrangement 12 has the frequency response illustrated in FIG. 6. FIG. 6 shows a graph of efficiency (provided on the y axis 52) versus frequency (provided on the x axis 54 which is orthogonal to the y axis).

The frequency response of the first antenna element 34 is illustrated by line 56 which rises to a plateau 57 at around 1.7 GHZ and then falls from the plateau 57 at around 2.2 GHz. The plateau 57 corresponds to the first resonant frequency band of the first antenna element 34.

The frequency response of the second antenna element 36 is illustrated by line 58 which rises to a first maxima 60 at 0.9 GHz, falls to a minima at 1.8 MHz and then rises to a second maxima 62 at 2.3 GHz. The first maxima 60 corresponds to the third resonant frequency band of the second portion 42 and the second maxima 62 corresponds to the second resonant frequency band of the first portion 40. From FIG. 6, it can be appreciated that the combination of the first and second resonant frequency bands (i.e. combining the plateau 57 with the second maxima 62) widens the bandwidth of the antenna arrangement 12 at around 2 GHz As will be appreciated from the above paragraphs, the first antenna element 34 and the first portion 40 are operable to function as parasitic antennas when the other of them is being directly electrically fed. This feature provides an advantage in that since the first antenna element 34 and the first portion 40 are operable at similar resonant frequency bands, the bandwidth of the antenna arrangement 12 is effectively broadened at those frequencies.

Additionally, external objects (such as a user's finger) may affect the performance of the antenna arrangement 12 less than an antenna arrangement which includes a parasitic antenna connected only to ground. In an antenna arrangement which includes a parasitic antenna connected only to ground, the performance of the parasitic antenna is heavily dependent on the electromagnetic coupling of the parasitic antenna to an active antenna. If a user places his finger above such an antenna arrangement, the electromagnetic coupling between the antennas may be reduced and consequently deteriorate the performance of the parasitic antenna. In embodiments of the present invention, the first antenna element 34 and the second antenna element 36 can be fed independently of one another and their performance is not solely dependent on electromagnetic coupling.

In one embodiment, the physical lengths of the first antenna element 34, the first portion 40 and the second portion 42 are 18 mm, 12 mm and 48 mm respectively. It will be appreciated that the physical lengths of the first antenna element 34 and the first portion 40 are different to one another. However, their electrical lengths are similar as they are both connected to matching circuit(s) 14, 24, 26 which include reactive components which are selected to provide them with similar electrical lengths. The gap (G) between the first antenna element 34 and the first portion 40 is 11 mm. In this embodiment, the first antenna element 34 has a resonant frequency band centred at 1.7 GHz, the first portion 40 has a resonant frequency band centred at 2.1 GHz and the second portion 42 has a resonant frequency band centred at 900 MHz. As mentioned above, it should be appreciated that since the first antenna element 34 and the first portion 40 are operable at similar resonant frequency bands, they increase the bandwidth of the antenna arrangement 12 at relatively high frequencies (at around 2 GHz).

Figure 7:
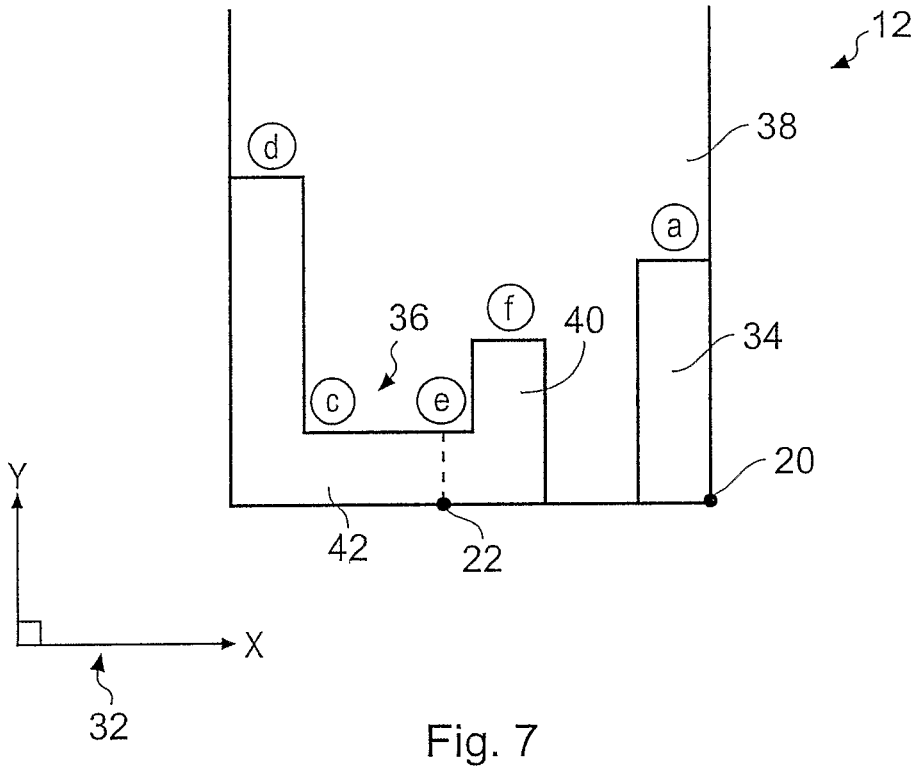
FIG. 7 illustrates a plan view of an antenna arrangement according to another embodiment of the present invention.

FIG. 7 illustrates a plan view of an antenna arrangement according to another embodiment of the present invention. The embodiment illustrated in FIG. 7 is similar to the embodiment illustrated in FIG. 3, and where the features are similar, the same reference numerals are used.

The embodiment illustrated in FIG. 7 differs from that illustrated in FIG. 3 in that the first portion 40 of the second antenna element 36 extends from the feed point 22 in the +x direction until point (e) where it makes a right angled, left hand bend and then extends in the +y direction (running parallel with the first antenna element 34) until its end point (f). This embodiment may provide an advantage in that it may increase the electromagnetic coupling between the first portion 40 and the first antenna element 34 because the end point (f) of the first portion 40 is brought closer to the end point (a) of the first antenna element 36 where the electric field is maximum.

Figure 8:
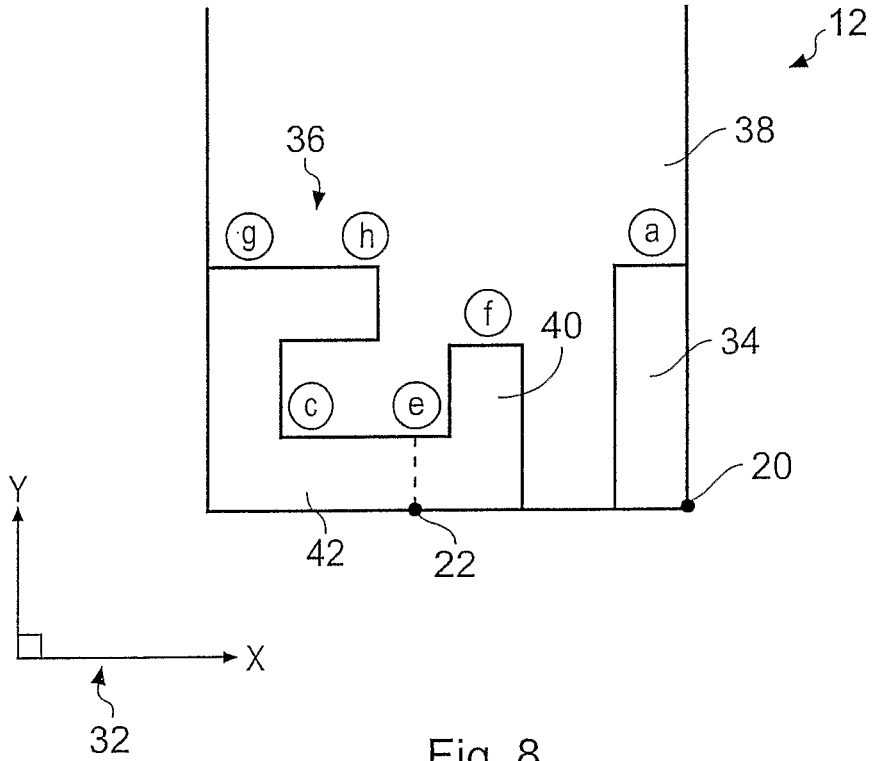
FIG. 8 illustrates a plan view of an antenna arrangement according to a further embodiment of the present invention.

FIG. 8 illustrates a plan view of an antenna arrangement according to a further embodiment of the present invention. The embodiment illustrated in FIG. 8 is similar to the embodiment illustrated in FIG. 7, and where the features are similar, the same reference numerals are used.

The embodiment illustrated in FIG. 8 differs from that illustrated in FIG. 7 in that the second portion 42 of the second antenna element 36 extend from point (c) in the +y direction until a point (g) where it makes a right angled, right hand bend. The second portion 42 then extends from the point (g) in the +x direction until its end point (h). This embodiment may provide an advantage in that it may reduce the volume required for the antenna arrangement 12 because the second portion 42 is folded (at points (c) and (g)) which reduces the extension of the second portion 42 in the +y direction.

Figure 9:
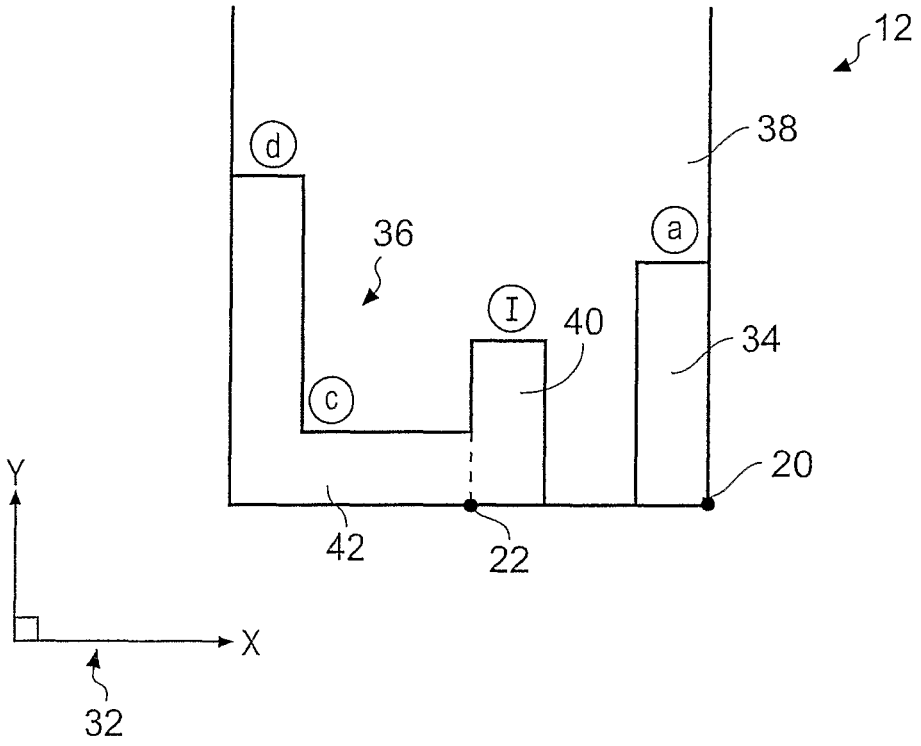
FIG. 9 illustrates a plan view of an antenna arrangement according to another embodiment of the present invention.

FIG. 9 illustrates a plan view of an antenna arrangement according to another embodiment of the present invention. The embodiment illustrated in FIG. 9 is similar to the embodiments illustrated in FIGS. 3 and 7, and where the features are similar, the same reference numerals are used.

The embodiment illustrated in FIG. 9 differs from the embodiments illustrated in FIGS. 3 and 7 in that the first portion 40 of the second antenna element 36 extends from the feed point 22 only in the +y direction until its end point (I). In this embodiment, the orientation of the first portion 40 is substantially parallel to the first antenna element 34 along the whole of its length $L_2$.

Since the electrical lengths of the first antenna element 34, the first portion 40 and the second portion 42 can be selected to achieve different resonant frequency bands, it should be appreciated that embodiments of the present invention are not limited to the resonant frequency bands mentioned above. For example, their lengths may be selected so that they are operable to resonate in any of the following resonant frequency bands and using different protocols. For example, the different frequency bands and protocols may include US-GSM 850 (824-894 MHz); EGSM 900 (880-960 MHz); PCN/DCS1800 (1710-1880 MHz); US-WCDMA1900 (1850-1990) band; WCDMA21000 band (Tx: 1920-1980I Rx: 2110-2180); and PCS1900 (1850-1990 MHz).

Additionally, it should be appreciated that embodiments of the present invention are not limited to only cellular protocols. Embodiments of the present invention may be operable using only cellular protocols, cellular and non-cellular protocols or only non-cellular protocols. For example, the non-cellular protocols may include 2.5 GHz WLAN/BT, 5 GHz WLAN and UWB 3-6 GHz.

Although embodiments of the present invention have been described in the preceding paragraphs with reference to various examples, it should be appreciated that modifications to the examples given can be made without departing from the scope of the invention as claimed. For example, the first antenna element 34 may be a Planar Inverted F antenna (PIFA), and/or the second antenna element 36 may be a PIFA.

PILA's provide an advantage over PIFA's in embodiments of the present invention because when a PIFA operates as a parasitic element, its electrical length is not adjusted by its connected matching circuit. Since it is not possible to increase the electrical length of a PIFA when it is operating as a parasitic antenna by providing reactive elements in the matching circuit, the physical length of the PIFA may be greater than the physical length of a PILA at any given operating frequency. Therefore, one advantage provided by the first and second antenna elements 34, 36 being PILA's is that they may reduce the volume required for the antenna arrangement 12.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a first antenna element having only one galvanic connection, the only one galvanic connection being physically connected to a first feed point, the first antenna element having a first electrical length, the first antenna element being a planar inverted L antenna element, the first antenna element being configured to resonate within a first resonant frequency band;

a second antenna element having only one galvanic connection, the only one galvanic connection being physically connected to a second feed point, different to the first feed point, the second antenna element being a planar inverted L antenna element, the second antenna element including:

a first portion extending from the second feed point towards the first antenna element to enable the first portion to electromagnetically couple with the first antenna element, and having a second electrical length configured to enable the first portion of the second antenna element to resonate within a second resonant frequency band, the first resonant frequency band and the second resonant frequency band having at least partially overlapping frequencies; and a second portion which extends from the second feed point and has a third electrical length, different to the first electrical length of the first antenna element and to the second electrical length of the first portion, wherein the second portion of the second antenna element is operable to resonate within a third resonant frequency band, different to the first resonant frequency band and to the second resonant frequency band, wherein the first antenna element and the second antenna element provide an antenna arrangement for a portable electronic device.

2. An apparatus as claimed in claim 1, wherein at least a part of the first portion of the second antenna element is oriented so that it is substantially parallel to the first antenna element.

3. An apparatus as claimed in claim 1, the first antenna element having a resonant mode at $\lambda/4$.

4. An apparatus as claimed in claim 1, the second antenna element having a resonant mode at $\lambda/4$.

5. An apparatus as claimed in claim 1, wherein the first antenna element is connectable to a first transceiver via the first feed point and the second antenna element is connectable to a second transceiver via the second feed point, the first transceiver being different to the second transceiver.

6. An apparatus as claimed in claim 1, wherein the first antenna element and the second antenna element are connectable to a single transceiver via the first feed point and the second feed point respectively.

7. A device comprising an apparatus as claimed in claim 1.

8. A portable electronic device comprising an apparatus as claimed in claim 1.

9. An apparatus as claimed in claim 2, wherein at least a further part of the first portion of the second antenna element is oriented so that it is substantially orthogonal to the first antenna element.

10. An apparatus as claimed in claim 1, wherein at least a first part of the second portion of the second antenna element is oriented so that it is substantially orthogonal to the first antenna element.

11. An apparatus as claimed in claim 10, wherein at least a second part of the second portion of the second antenna element is oriented so that it substantially parallel to the first antenna element.

12. An apparatus as claimed in claim 11, wherein at least a third part of the second portion of the second antenna element is oriented so that it is substantially orthogonal to the first antenna element, wherein the first part extends away from the first antenna element from the second feed point towards a first end portion of the second part, and wherein the third part extends from a second end portion of the second part towards the first antenna element.

13. An apparatus as claimed in claim 1, wherein the portable electronic device is a mobile cellular telephone.

14. A portable electronic device as claimed in claim 8, wherein the portable electronic device is a mobile cellular telephone.

15. A method comprising:

providing a first antenna element, of an antenna arrangement, having only one galvanic connection, the only one galvanic connection being physically connected to a first feed point, the first antenna element having a first electrical length, the first antenna element being a planar inverted L antenna element, the first antenna element being configured to resonate within a first resonant frequency band;

providing a second antenna element, of an antenna arrangement, having only one galvanic connection, the only one galvanic connection being physically connected to a second feed point, different to the first feed point, the second antenna element being a planar inverted L antenna element, the second antenna element including:

a first portion extending from the second feed point towards the first antenna element to enable the first portion to electromagnetically couple with the first antenna element, and having a second electrical length configured to enable the first portion of the second antenna element to resonate within a second resonant frequency band, the first resonant frequency band and the second resonant frequency band having at least partially overlapping frequencies, and a second portion which extends from the second feed point and has a third electrical length, different to the first electrical length of the first antenna element and to the second electrical length of the first portion, wherein the second portion of the second antenna element is operable to resonate within a third resonant frequency band, different to the first resonant frequency band and to the second resonant frequency band, wherein the first antenna element and the second antenna element provide an antenna arrangement for a portable electronic device.

16. A method as claimed in claim 15, wherein at least a part of the first portion of the second antenna element is oriented so that it is substantially parallel to the first antenna element.

17. A method as claimed in claim 15, wherein the first antenna element is connectable to a first transceiver via the first feed point and the second antenna element is connectable to a second transceiver via the second feed point, the first transceiver being different to the second transceiver.

18. A method as claimed in claim 15, wherein the first antenna element and the second antenna element are connectable to a single transceiver via the first feed point and the second feed point respectively.

* * * * *